US010694790B2

(12) United States Patent
Blackwood

(10) Patent No.: US 10,694,790 B2
(45) Date of Patent: Jun. 30, 2020

(54) BLC DOWN UTILITY JACKET AND VEST

(71) Applicant: Matthew Blackwood, Fresno, CA (US)

(72) Inventor: Matthew Blackwood, Fresno, CA (US)

( * ) Notice: Subject to any disclaimer, the term of this patent is extended or adjusted under 35 U.S.C. 154(b) by 111 days.

(21) Appl. No.: 15/901,023

(22) Filed: Feb. 21, 2018

(65) Prior Publication Data

US 2019/0254366 A1 Aug. 22, 2019

(51) Int. Cl.

| | |
|---|---|
| ***A41D 1/02*** | (2006.01) |
| ***A41D 1/04*** | (2006.01) |
| ***A41D 27/10*** | (2006.01) |
| ***A41D 27/18*** | (2006.01) |
| ***A41D 27/02*** | (2006.01) |
| ***A41D 27/20*** | (2006.01) |
| ***A41D 3/02*** | (2006.01) |

(52) U.S. Cl.

CPC ..... *A41D 1/02* (2013.01); *A41D 1/04* (2013.01); *A41D 3/02* (2013.01); *A41D 27/02* (2013.01); *A41D 27/18* (2013.01); *A41D 27/20* (2013.01); *A41D 2200/20* (2013.01); *A41D 2300/22* (2013.01); *A41D 2300/322* (2013.01)

(58) Field of Classification Search

CPC ..... A41D 2300/22

USPC ..... D2/829

See application file for complete search history.

(56) References Cited

U.S. PATENT DOCUMENTS 6,029,270 A * 2/2000 Ost ..... A41D 3/00 2/2.5

2012/0283805 A1* 11/2012 Ragonesi ..... A61F 7/02 607/109

2014/0298574 A1* 10/2014 Williams ..... A41D 13/0512 2/459

FOREIGN PATENT DOCUMENTS

CN 206909715 U * 1/2018

OTHER PUBLICATIONS

Yeoukou Men's Military Connto Multi POckets HOoded M65 Field Moto Jacket Coat; Amazon.com website; https://www.amazon.com/Yeokou-Military-Cotton-Pockets-Hooded/dp/B075M4CKK6; Sep. 13, 2017 (Year: 2017).*

News from Oakland Harley-Davidson; https://news.oaklandh-d.com/whats-trending-in-motorclothes-in-the-bay-area; Feb. 27, 2017. (Year: 2017).*

Men's Leather Motorcycle Jacket; Amazon.com website; https://www.amazon.com/Leather-Motorcycle-Premium-Concealed-Adjustable/dp/B0771RVSPN/ref=sr_1_9?keywords=jacket+waist+buckle&qid=1569331027&sr=8-9; Oct. 31, 2017. (Year: 2017).*

* cited by examiner

*Primary Examiner* — Daniel J Colilla

(74) *Attorney, Agent, or Firm* — Miller IP Law, LLC

(57) ABSTRACT

The invention relates to composite memory foam and its uses in the manufacture of jacket for exclusive body supports. The invention also relates to a method of adding or removing composite memory foam when dry cleaning is required. The composite memory foam includes a polyurethane foam and granules of a polyurethane polymer embedded in the polyurethane foam where the memory foam is exclusively added in collar, elbow, and back panel of jacket to improve the support and comfort level.

19 Claims, 4 Drawing Sheets

BLC DOWN UTILITY JACKET AND VEST

BACKGROUND

Field of the Invention

The present invention relates to a clothing or an outer garment or more particularly related to a cushioning jacket consisting of an outer cloth and inner mesh pocket. The invention, substitutable for conventional jackets, which will provide further convenience, more comfort, and satisfaction for the user without compromising the functionality of jackets.

Description of the Related Art

Every year, buyers spend millions of dollars purchasing "external wearables". Each wearable claim to provide a customized fit. However, previously designed wearables typically overpromise and fail to deliver what is best suited for customers and beneficial for them in long term.

When it comes to jackets, whether it's a chic leather jacket for hitting the best clubs or a more traditional conservative design there's an assortment of looks and technology available, there is a jacket to suit every one's taste for style or need for functionality. The array of looks and technologies that jackets offer can be dizzying, though. Jackets can be waterproof, windproof, or insulated. They can vary in length, feature a hood or a collar. Jackets can also be cut in various ways to fit differently on a man's body and express different aesthetics. Some jackets are more appropriate for business wear, while others are designed for specific sporting events or looking good on the street.

But nobody promises that the jacket you are buying will fit you well. Every individual has a unique size and cut. After wearing undergarments and garments, sometimes wearing a jacket can be uncomfortable experience. The essential issue for the current jackets is that there are commonly just standard sizes (i.e. little, medium, large or extra-large). Be that as it may, each end client has an interestingly molded body and with standard cuts the external article of clothing (i.e. Utility Vest and Jacket) currently provides a generic and uncomfortable fit.

According to U.S. Pat. No. 5,201,075 issued to Ronald J. Svetich on 1992 Sep. 4 displays an Athlete's arm jacket which includes a first shell portion for covering one side of the upper torso of a person wearing the jacket. A sleeve is secured to the shell portion for covering one arm. A mesh covers the opposite side of the upper torso, and a second shell portion is detachably secured to the first shell portion. Another sleeve is attached to the second shell portion. The jacket may be worn and used as a traditional jacket, or one shell portion may be detached so that only one arm, shoulder and one side of the upper torso of the body are covered. However, this invention doesn't explain how people with different body structures will wear the jacket and how comfortable it will be for them.

According to U.S. Pub. No. 2004/019,976 to Juliana Hunt published on 2003 Apr. 10 a jacket that may be used in hot weather is disclosed. The jacket may be particularly useful for motorcycle and equestrian riders. The jacket is sufficiently fashionable and stylish such that it may be worn on other occasions as well. According to some aspects, the jacket includes two sleeves, a chest portion, and a back portion. The chest portion is shorter than conventional jackets, and according to some arrangements, the chest portion is designed to accent a woman's figure and be worn above the wearer's breast line. A zipper, snaps, buttons, or Velcro, and/or decorative trim may also be added. Similarly, this jacket is also for creating fashion statement but its fit to everyone's unique body structure is still a question.

Our invention BLC Down Utility Jacket & Vest is not only attractive looking but also has memory foam embedded in zipper placement, hood location to help user feel comfortable according to his/her size. With this new technology, it is anticipated that the memory foam will remember and adjust to the unique contours of the individual's body so that it is more of a customized fit.

None of the previous inventions and patents, taken either singularly or in combination, seem to describe the instant invention as claimed. Hence, the inventor of the present invention proposes to resolve and surmount existent technical difficulties to eliminate the aforementioned shortcomings of prior art.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

It is an important object of the present invention to provide extreme flexibility and adaptability of the garment as per every wearer's unique body shape and for many different portions of the body or different sets of body muscles.

It is the general object of current invention to provide a jacket with memory foam embedded in addition to the other parts of clothing including zipper, hood, front and back parts, padded sleeves and collar.

It is the object of the current invention to provide a memory foam embedded jacket to best fit according to the shape and size of the individual wearing it.

It is also the object of the current invention to provide a jacket with the memory foam embedded in the collar and back side of the jacket or vest.

It is the object of the current invention to provide a jacket/vest with memory foam which can be removed and placed as per the requirements.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1:
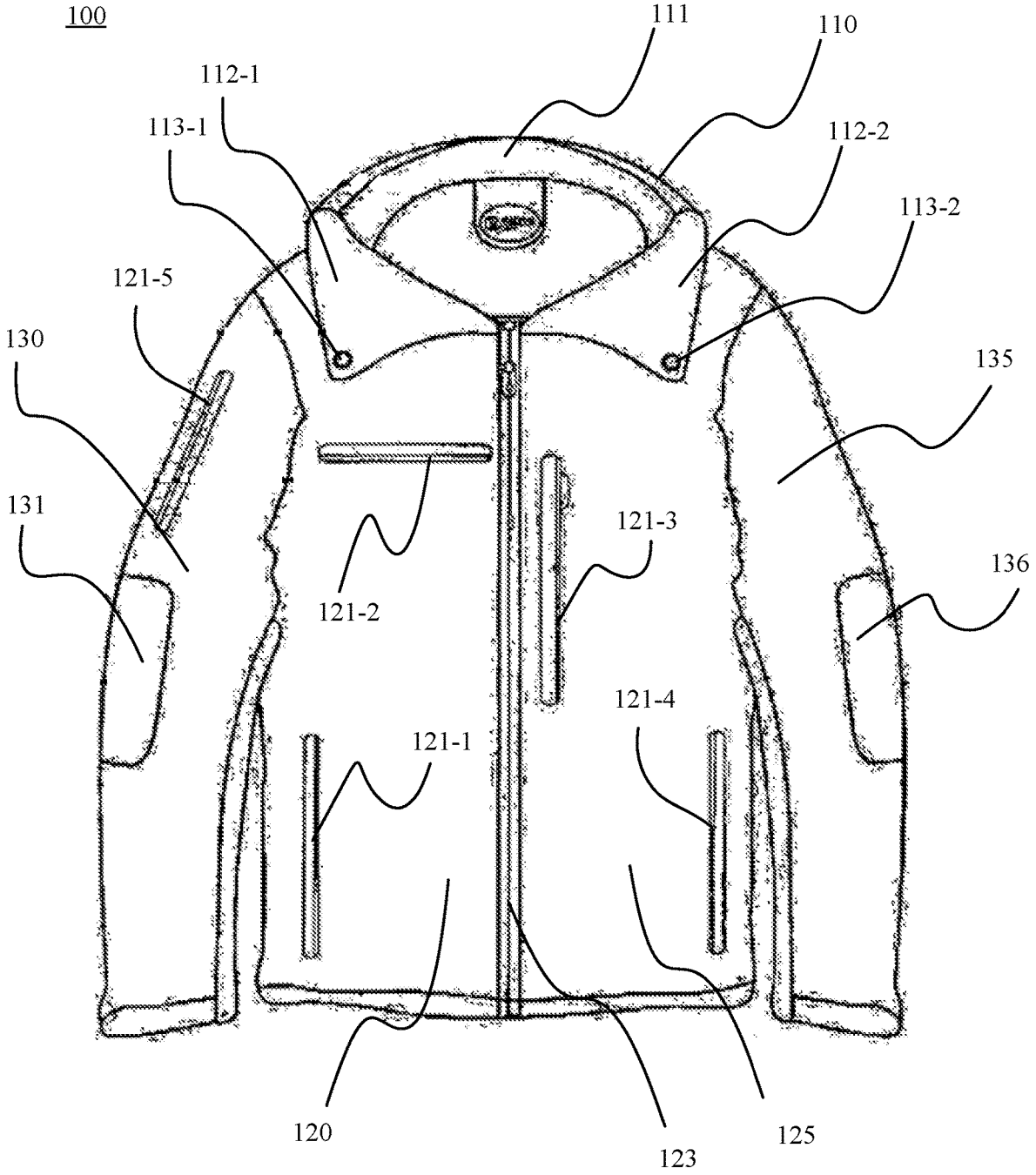
FIG. 1 is a front view of BLC Down Utility Jacket according to an embodiment of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Jacket is a garment that can help you withstand the cold, wind, and snow or rain. It contains thick insulation so that your body stays warm even when not in motion. The thinner insulated layers are often part of an integrated system of layers, to give the user ultimate discretion in warmth and perspiration management when used during winter activities.

A good winter jacket needs to keep you and the insulation dry and should have a waterproof/breathable outer shell. Besides being functional in a cold environment, these jackets also tend to have a longer cut and more attention to how they will look on casual or more formal occasions. In contrast to their lightweight counterparts used for cold weather sports, casual models often include many more features that add to their comfort and livability, since weight is not a primary consideration.

With all the requirements and sky-high prices how much these jackets are as per the requirements. Wearing the jacket at the top can be uneasy when it doesn't fit well. Currently there are standard UtilityJackets and Vests (without memory foam inserts) in the fashion marketplace. Primary use of any jacket is to form a protective outer covering for the end user, but what if it doesn't go well with your body. Here the problem is resolved with the usage of memory foam in the jacket/vest. What is a memory foam? Memory foam was first designed in the mid-1960s for NASA airplane seats; memory foam is made from a substance called viscoelastic. It is both highly energy absorbent and soft. Memory foam molds to the body in response to heat and pressure, evenly distributing body weight. It then returns to its original shape once you remove the pressure.

In addition to protecting against impact, these properties make memory foam very comfortable. After its "virgin flight" for NASA, memory foam made a foray into other applications. For example, it was used as cushioning in helmets and shoes. Medicine found a use for it in prosthetics and products to prevent pressure ulcers such as seating pads for people who are severely disabled.

Then, memory foam really took off. It's now well known for its use in pillows, mattress pads, and mattresses, which come in different densities and depths. When you wear the garments using the memory foam, the heat from your body softens it in appropriate points," and this helps to support your body along the curves and natural lines of the body." Memory foam manufacturers claim this helps relieve muscles and pain and thereby promotes more restful and comfort vibes.

Memory foam is now an already used technology that has provided greater support for individuals wearing bra's, undergarments, shoes, and mattresses before. There are potential uses of memory foam that is not realized in jacket/vest form of clothing.

Referring to Undergarment with memory foam insert U.S. Pat. No. 7,731,564 B2, disclosed is a use of a memory foam insert in bras, camisoles, shorts, and briefs. The memory foam insert is designed to limit and prevent the bouncing motion through the breast and gluteal area during rigorous athletic activity. The invention conforms and molds itself to the individual's shape and figure, thereby allowing for a comfortable and secure fit.

Similarly referring to the patent technology of Composite memory foam and uses as of US Pat. Pub. No. 2012/0316254 A1. The invention relates to composite memory foam and its uses in the manufacture of mattresses, pillows and other body supports. The invention also relates to a method of manufacturing mattresses, pillows and other body support from composite memory foam. The composite memory foam includes a polyurethane foam and granules of a polyurethane polymer embedded in the polyurethane foam.

Keeping in view the utility of jackets and vests and every individual's shape and size, these jackets are designed to provide comfort to every level. Its memory foam technology embedded in the collar and along back makes, it best fit as per the consumer size.

In one embodiment of the invention, higher-density memory foam softens in reaction to body heat, allowing it to mold to a warm body in a few minutes. The foam is temperature sensitive, so it tends to sink more as the body temperature warms it up. Very quickly, it molds to the wearer's unique contours. As the foam sinks as per each person's body, shape the body is always perfectly supported and shoulders, neck and the spine remain straight. The weight is spread more evenly, and the pressure is relieved on places like your shoulders and back.

In additional embodiment of the invention the people who will wear the jacket will find great relieve in the reduction of the symptoms of problems such as backpain and arthritis. If you change position or turn over, the mattress gradually molds to your new shape In another embodiment of the invention the memory foam can be removed during dry cleaning for its durability and long life. The memory foam can be removed and installed easily and thus this jacket provides an enduring support to its wearer.

Along with this, the clothing article includes connected front portion, a collar. A sleeve is formed in the front portion. A jacket, and coat with an attachable/detachable scarf (not shown) will be folded and stored in the inter portion of the front side of the collar area with elastic at each end and Velcro onto the inner portion of your collar, therefore eliminating the loss of them by any consumers, and especially children. A sleeve like collar attached to the coat and jacket for storing a scarf and making it easily deployable while in use.

Further an additional embodiment of the invention is that the jacket will provide the comfort while simultaneously remaining lightweight and durable for the end user.

Figure 2:
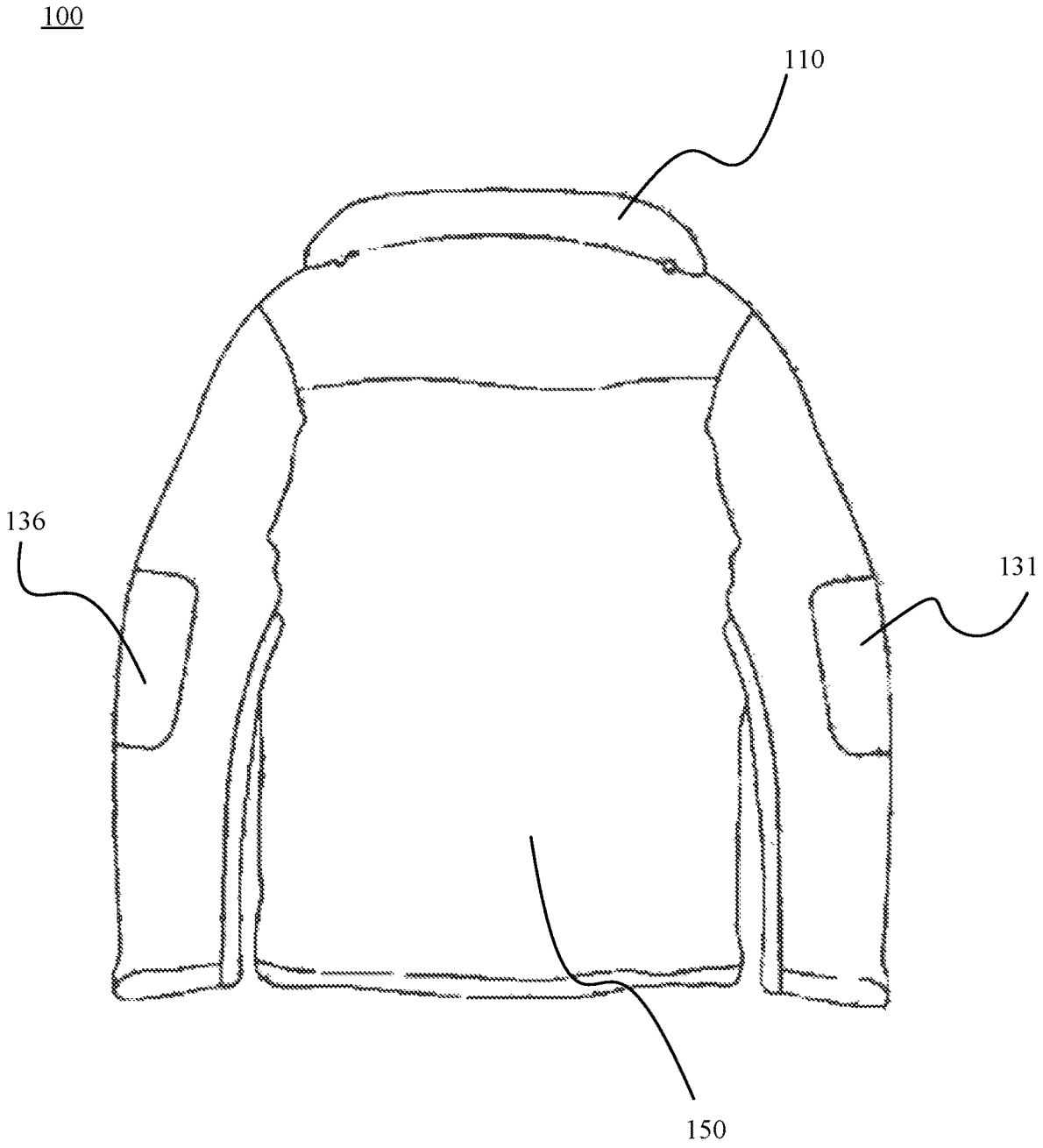
FIG. 2 is a back view of BLC Down Utility Jacket according to an embodiment of the present invention.

FIGS. 1 and 2 depict BLC Down Utility Jacket 100 (also referred herein as "jacket 100") accordingly to an embodiment. FIG. 1 depicts a front view of jacket 100 and FIG. 2 depicts a back view of jacket 100. Jacket 100 includes collar 110, lapel 112-1, lapel 112-2, front panel 120, front panel 125, sleeve 130, and sleeve 135.

Collar 110 includes foam 111 (e.g., memory foam) that extends along a length of collar 110. In one embodiment, foam 111 is embedded along an inner-surface of collar 110.

Collar 110 includes a first distal end and a second distal end. Lapel 112-1 is disposed at the first distal end of collar 110 and lapel 112-2 is disposed at the second distal end of lapel 110. Lapel 112-1 includes snap 113-1 at a point of lapel 112-1. In one embodiment, lapel 112-1 is coupled to front panel 120 via a metal fastening stud. Lapel 112-2 includes snap 113-2 9 at a point of lapel 112-2. In one embodiment, lapel 112-2 is coupled to front panel 125 via a metal fastening stud.

Collar 110 also includes a hood (not shown) removably coupled (e.g., detachable) with collar 110. In one embodiment, the hood is stored within collar 110.

Front panel 120 includes pocket 121-1 having a vertical opening and pocket 121-2 having a horizontal opening. Front panel 125 includes pocket 121-3 having a vertical opening and pocket 121-4 having a vertical opening. Front panel 120 and front panel 125 are releasably coupled (e.g., cinched) together via a zipper 123.

In various embodiments, jacket 110 includes one or more inner pockets (not shown). An inner pocket is a pocket that has an opening on an inner surface of jacket 100. For example, front panel 120 includes one or more inner pockets and/or front panel 125 includes one or more inner pockets. In one embodiment, jack 100 includes three inner pockets.

Sleeve 130 includes pocket 121-5 having a vertical opening. Sleeve 130 includes elbow panel 131. Elbow panel 131 is a padded panel. For example, elbow panel 131 is comprised of memory foam.

Sleeve 135 includes elbow panel 136. Elbow panel 136 is a padded panel. For example, elbow panel 136 is comprised of memory foam.

Jacket 100 includes an inner lining (not shown) disposed on the inside surface of jacket 100. In various embodiments, the memory foam, described herein, is embedded within the inner lining of jacket 100. In one embodiment, the inner lining is a cotton lining to provide a comfortable fit. Additionally, the inner lining keeps the memory foam from being entangled and safe.

In various embodiments, jacket 100 includes a waist buckle (not shown) that runs along a lower edge of jacket 100 can create a more settled fit.

Jacket 100 includes back panel 150. In one embodiment, memory foam is inserted along back panel 150. For example, memory foam is inserted along a whole (or an entirety) of back panel 150.

Figure 3:
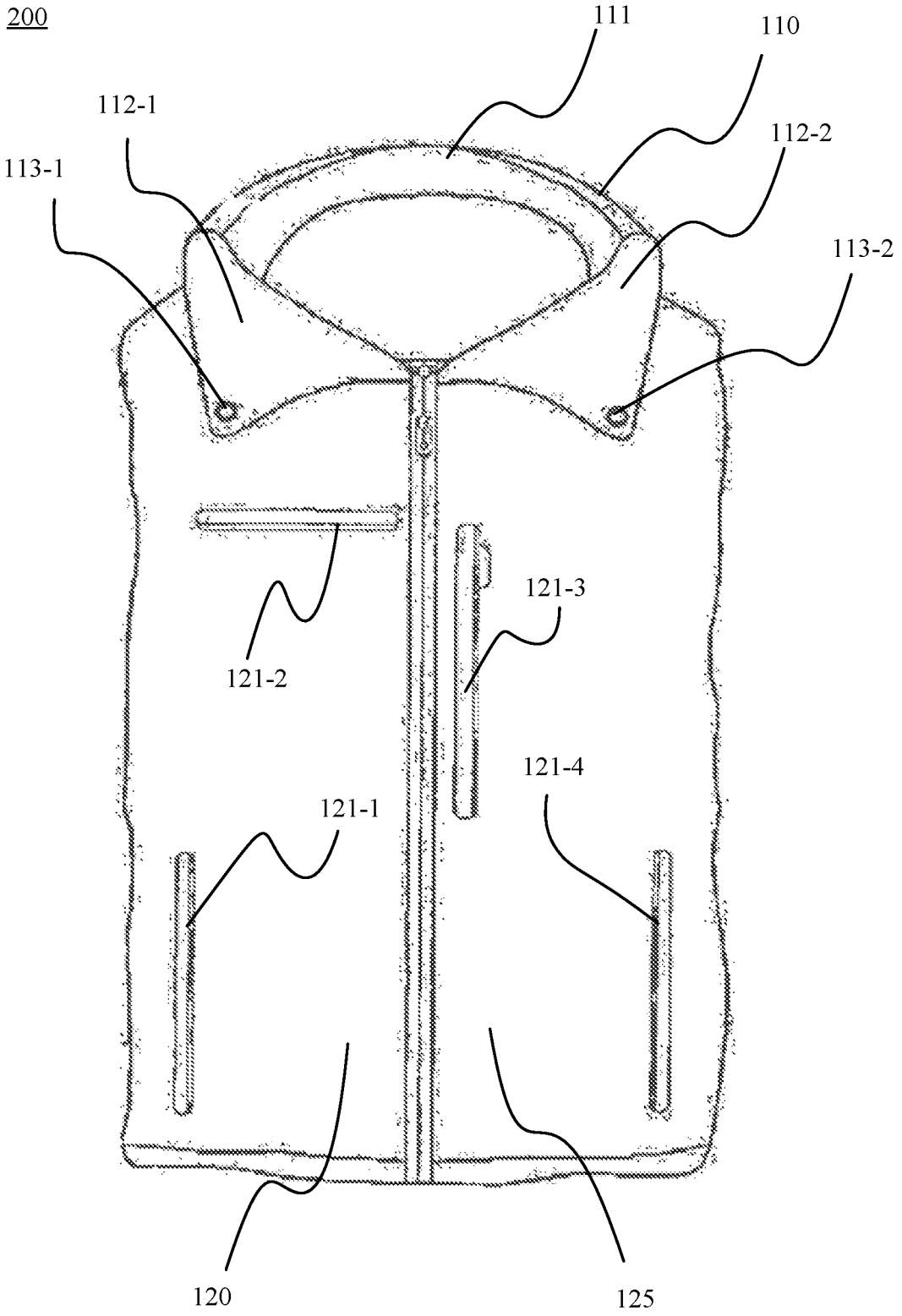
FIG. 3 is a front view of BLC Down Utility Vest according to an embodiment of the present invention.
Figure 4:
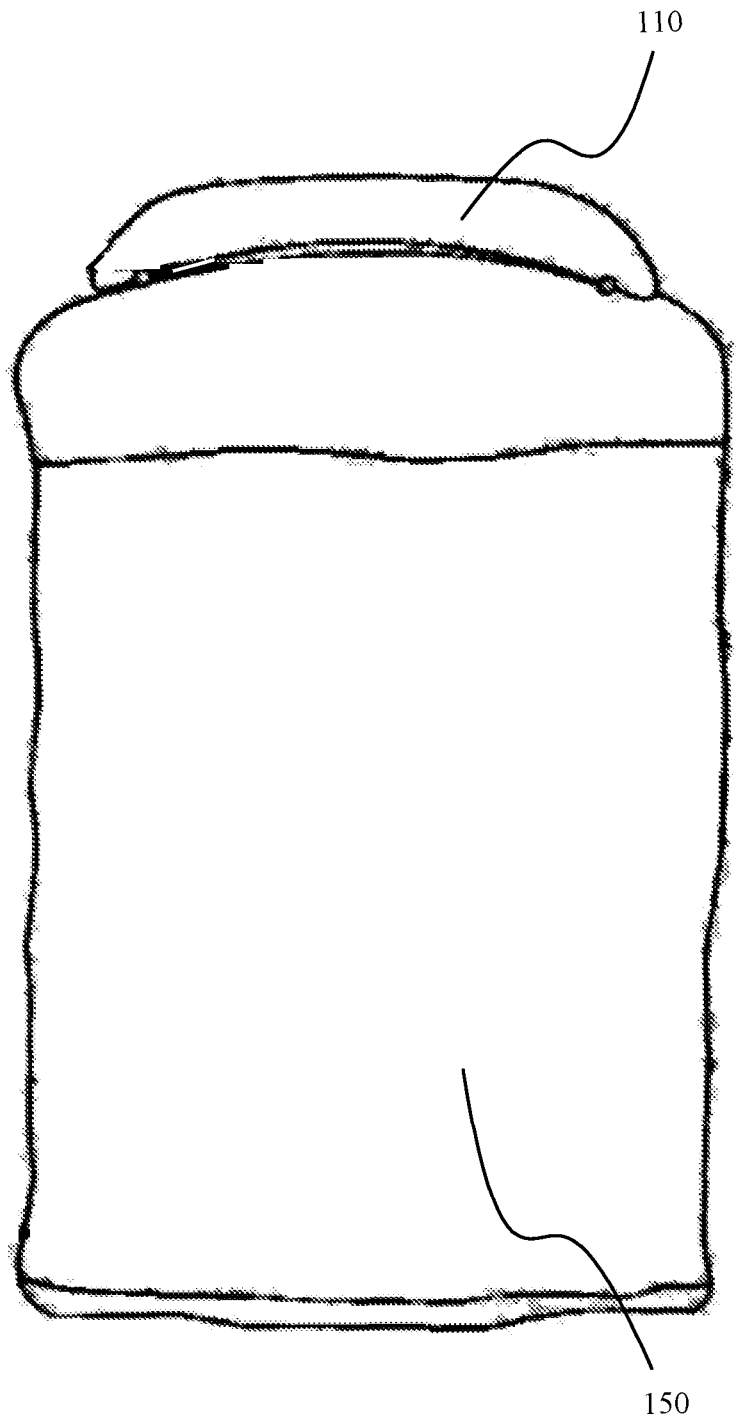
FIG. 4 is a back view of BLC Down Utility Vest according to an embodiment of the present invention.

FIGS. 3-4 depict BLC Down Utility Vest 200 (also referred herein as "vest 200") accordingly to an embodiment. FIG. 3 depicts a front view of vest 200 and FIG. 4 depicts a back view of vest 200. In various embodiments, vest 200 is similar to jacket 100. As such, vest 200 includes similar features and functionality as described herein with respect to jacket 100. For example, vest 200 includes, among other things, collar 110, lapel 112-1, lapel 112-2, front panel 120 and front panel 125. However, vest 200 does not include sleeves.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A jacket, comprising:

a torso portion configured to cover a torso of an individual, the torso portion comprising:

a first front panel, comprising:

a first pocket comprising a first pocket opening, wherein:

the first pocket opening:

is accessible from a first outer surface of the first front panel; and is disposed horizontally on the first outer surface of the first front panel; and the first pocket is disposed along a first inside surface of the first front panel; and a second pocket comprising a second pocket opening, wherein:

the second pocket opening:

is accessible from the first outer surface of the first front panel; and is disposed vertically on the first outer surface of the first front panel; and the second pocket is disposed along the first inside surface of the first front panel; and a second front panel laterally adjacent the first front panel, comprising:

a third pocket comprising a third pocket opening, wherein:

the third pocket opening:

is accessible from a second outer surface of the second front panel; and is disposed vertically on the second outer surface of the second front panel; and the third pocket is disposed along a second inside surface of the second front panel; and a fourth pocket comprising a fourth pocket opening, wherein:

the fourth pocket opening:

is accessible from the second outer surface of the second front panel; and is disposed vertically on the second outer surface of the second front panel; and the fourth pocket is disposed along the second inside surface of the second front panel; and a back panel coupled to the first front panel and the second front panel, the back panel comprising a first memory foam panel disposed along an entirety of the back panel, wherein the first foam panel is to remember and adjust to unique contours of a back of the individual;

a first sleeve coupled to a first upper portion of the first front panel comprising:

a fifth pocket comprising a fifth pocket opening, wherein:

the fifth pocket opening:

is accessible from a third outer surface of the first sleeve; and is disposed vertically along the third outer surface of the first sleeve; and the fifth pocket is disposed along a third inside surface of the first sleeve; and a first elbow portion comprising a second memory foam panel to remember and adjust to unique contours of a first elbow of the individual;

a second sleeve coupled to a second upper portion of the second front panel comprising a second elbow portion comprising a third memory foam panel to remember and adjust to unique contours of a second elbow of the individual;

a collar coupled to:

the first upper portion of the first front panel;

the second upper portion of the second upper panel; and the back panel, wherein the collar comprises:

a first lapel coupled to a first end of the collar comprising a first snap disposed at a first vertices of the first lapel to couple the first lapel to the first front panel;

a second lapel coupled to a second end of the collar comprising a second snap disposed at a second vertices of the second lapel to couple the second lapel to the second front panel; and a fourth memory foam panel disposed along an inner surface of the collar and extends from the first end of the collar to the second end of the collar, wherein the fourth memory foam panel is configured to:

remember and adjust to unique contours of a neck of the individual; and contact the neck of the individual; and a hood coupled to the collar.

2. The jacket of claim 1, wherein:

the first memory foam panel is embedded within the back panel;

the second memory foam panel is embedded within the first elbow portion;

the third memory foam panel is embedded within the second elbow portion; and the fourth memory foam panel is embedded within the collar.

3. The jacket of claim 1, wherein:

the first memory foam panel is removably coupled to the back panel to allow the individual to remove the first memory foam panel from the back panel for cleaning;

the second memory foam panel is removably coupled the first elbow portion to allow the individual to remove the second memory foam panel from the first elbow portion for cleaning;

the third memory foam panel is removably coupled to the second elbow portion to allow the individual to remove the third memory foam panel from the second elbow portion for cleaning; and the fourth memory foam panel is removably coupled to the collar to allow the individual to remove the fourth memory foam panel from the collar for cleaning.

4. The jacket of claim 1, further comprising an inner lining disposed proximate an inner surface of the jacket, wherein:

the first memory foam panel is inserted between the inner lining and the back panel;

the second memory foam panel is inserted between the inner lining and the first elbow portion;

the third memory foam panel is removably is inserted between the inner lining and the second elbow portion; and the fourth memory foam panel is inserted between the inner lining and to the collar.

5. The jacket of claim 1, further comprising:

a first internal pocket accessible from a first internal pocket opening;

a second internal pocket accessible from a second internal pocket opening; and a third internal pocket accessible from a third internal pocket opening.

6. The jacket of claim 1, further comprising a waist belt disposed on a lower edge of the torso portion.

7. The jacket of claim 1, further comprising:

a scarf releasably coupled to the jacket; and an inner pocket disposed proximate the collar, wherein the scarf is stored within the inner pocket.

8. The jacket of claim 1, wherein the third pocket opening of the third pocket is disposed between second pocket opening of the second pocket and the fourth pocket opening of the fourth pocket.

9. The jacket of claim 1, wherein the third pocket opening of the third pocket is between the third pocket opening of the third pocket and the fourth pocket opening of the fourth pocket.

10. A vest, comprising:

a torso portion configured to cover a torso of an individual, the torso portion comprising:

a first front panel, comprising:

a first pocket accessible from an outer surface of the torso portion, wherein a first pocket opening of the first pocket extends along a horizontal line;

a second pocket accessible from the outer surface of the torso portion; and a second front panel laterally adjacent the first front panel, comprising:

a third pocket accessible from an outer surface of the torso portion, wherein a distal end of a second pocket opening of the third pocket is adjacent the horizontal line; and a fourth pocket accessible from an outer surface of the torso portion;

a back panel coupled to the first front panel and the second front panel, the back panel comprising a first memory foam panel disposed along an entirety of the back panel, wherein the first foam panel is to distribute weight of the vest along a back of the individual thereby relieving pressure on the back of the individual; and a collar coupled to:

the first front panel;

the second front panel; and the back panel, wherein the collar comprises:

a first lapel proximate the collar comprising a first coupling device disposed at a first vertices of the first lapel to couple the first lapel to the first front panel;

a second lapel proximate the collar comprising a second coupling device at a second vertices of the second lapel to couple the second lapel to the second front panel; and a second memory foam panel disposed along a length of an inner surface of the collar, wherein the second memory foam panel distributes the weight of the vest along a neck of the individual thereby relieving pressure on the neck of the individual.

11. The vest of claim 10, further comprising:

a hood detachable coupled to the collar.

12. The vest of claim 10, wherein:

the first coupling device is a first metal stud fastener; and the second coupling device is a second metal stud fastener.

13. The vest of claim 10, wherein:

the collar further comprises a first top surface; and the second memory foam panel comprises a second top surface aligned with the first top surface.

14. The vest of claim 10, wherein the third pocket opening of the third pocket is closed by a zipper.

15. The vest of claim 14, wherein:

the first pocket is a first open pocket;

the second pocket is a second open pocket; and the fourth pocket is a third open pocket.

16. A method for inserting memory foam in a jacket, comprising:

inserting a first memory foam panel between an inner lining of the jacket and a collar of the jacket, wherein the first memory foam panel is to improve fit of the jacket by conforming to contours of a neck of an individual wearing the jacket;

inserting a second memory foam panel between the inner lining of the jacket and a back panel of the jacket, wherein the second memory foam panel is to improve the fit of the jacket by conforming to contours of a back of the individual wearing the jacket;

inserting a third memory foam panel between the inner lining of the jacket and a first elbow portion of the jacket, wherein the third memory foam panel is to improve the fit of the jacket by conforming to contours of a first elbow of the individual wearing the jacket; and inserting a fourth memory foam panel between the inner lining of the jacket and a second elbow portion of the jacket, wherein the fourth memory foam panel is to improve the fit of the jacket by conforming to contours of a second elbow of the individual wearing the jacket.

17. The method of claim 16, further comprising, upon the individual not wearing the jacket:

removing the first memory foam panel from between the inner lining of the jacket and the collar of the jacket;

removing the second memory foam panel from between the inner lining of the jacket and the back panel of the jacket;

removing the third memory foam panel from between the inner lining of the jacket and the first elbow portion; and removing the fourth memory foam panel from between the inner lining of the jacket and the second elbow portion.

18. The method of claim 16, wherein a length of the collar and a length of the first memory foam panel are the same.

19. The method of claim 16, further comprising:

accessing a scarf stored in the jacket; and wearing the scarf by the individual.

* * * * *